US005749254A

United States Patent [19]

Hall, Jr.

[11] Patent Number: 5,749,254

[45] Date of Patent: May 12, 1998

[54] AIR BEARING ASSIST IN PNEUMATIC FORMING OF THIN FOIL MATERIALS

[75] Inventor: Herbert L. Hall, Jr., Newark, Ohio

[73] Assignee: Owens-Corning Fiberglas Technology, Inc., Summit, Ill.

[21] Appl. No.: 413,676

[22] Filed: Mar. 30, 1995

Related U.S. Application Data

[63] Continuation-in-part of Ser. No. 238,992, Oct. 25, 1994, Pat. No. 5,540,075.

[51] Int. Cl.[6] ..... B21D 26/02; B23P 17/00

[52] U.S. Cl. ..... 72/60; 72/54; 72/709; 29/421.1

[58] Field of Search ..... 72/60, 63, 54, 72/709; 29/421.1

[56] References Cited

U.S. PATENT DOCUMENTS

| | | | |
|---|---|---|---|
| 2,745,173 | 5/1956 | Janes . | |
| 4,354,369 | 10/1982 | Hamilton | 72/60 |
| 4,516,419 | 5/1985 | Agrawl | 72/60 |
| 4,901,552 | 2/1990 | Ginty et al. | 72/60 |
| 4,951,491 | 8/1990 | Lorentz | 72/60 |
| 4,984,348 | 1/1991 | Cadwell | 72/60 |
| 5,090,981 | 2/1992 | Rusek, Jr. . | |
| 5,094,899 | 3/1992 | Rusek, Jr. . | |
| 5,376,424 | 12/1994 | Watanabe . | |
| 5,419,170 | 5/1995 | Sanders et al. | 72/60 |

FOREIGN PATENT DOCUMENTS

| | | | |
|---|---|---|---|
| 1462017 | 12/1966 | France | 72/60 |
| 3125367 | 1/1983 | Germany | 72/60 |
| 1240490 | 6/1986 | U.S.S.R. | 72/60 |

*Primary Examiner*—David Jones

*Attorney, Agent, or Firm*—C. Michael Gegenheimer; Curtis B. Brueske

[57] ABSTRACT

A method for pneumatic forming of foil workpieces includes the steps of positioning a foil workpiece between a first and a second forming element, the second forming element having at least one forming cavity, moving the first and second forming elements into a clamping relationship with the foil workpiece, increasing pneumatic pressure between the first forming element and the foil workpiece to form the foil workpiece into the forming cavity, supplying a gas between the foil and the second forming element sufficient to enable the foil workpiece to move along the surface of the second forming element during the forming of the foil workpiece into the forming cavity, and removing the foil workpiece in a formed condition from between the first and second forming elements.

20 Claims, 4 Drawing Sheets

AIR BEARING ASSIST IN PNEUMATIC FORMING OF THIN FOIL MATERIALS

RELATED APPLICATION

The present application is a Continuation-in-Part of commonly assigned, U.S. patent application Ser. No. 08/238,992, filed Oct. 25, 1994 (Hall), and entitled METHOD AND APPARATUS FOR SHOCK RELEASE OF THIN FOIL MATERIALS, now U.S. Pat. No. 5,540,075.

TECHNICAL FIELD

This invention relates to the forming of thin foils and, more specifically, to a method and apparatus for pneumatic forming of thin foil workpieces into simple or complex shapes at high speeds without lubricants, using reduced pneumatic pressures at the workpiece.

BACKGROUND

Conventional and emerging technologies have needs for parts made of thin foil materials, particularly thin foil metal materials. It has been found that existing forming operations are unable to cost-effectively form thin foil materials into parts having desired shapes with simple and compound surfaces, and features such as wrinkle-free flanges.

For example, in the manufacture of thin foil trays suitable for use in vacuum insulation panels, such as shown in U.S. Pat. No. 2,745,173, issued May 15, 1956 to Janos, metal materials are desirable for use because of their strength and ability to seal for vacuum retention. However, this particular application requires substantially wrinkle-free flanges for vacuum tight sealing of the formed part to other parts. While thin foil materials would be desirable for reduced conductive heat leak across such insulation panels, it has been necessary to stamp thicker cold-rolled carbon steel sheet material to practice the invention of the '173 patent.

Conventional processes applied to produce thin foil metal material parts, such as trays, have limitations and drawbacks which make their use in commercial production problematic. Conventional processes include matched metal die stamping, thermoforming, hydroforming, and rubber pad forming.

Matched metal dies are expensive to machine, expensive to align for use, and require high clamping pressures. Insufficient clamp pressure or imperfect flatness between the two mating halves of the tool permits excessive motion of a foil workpiece into the forming tool, and results in a buckling mode type of failure of the foil which produces wrinkles. However, as some material draw is desirable, excessive clamping force does not solve the problem of wrinkling and further promotes tearing of thin foils during forming. In addition, matched metal dies produce shapes with non-uniform stress distribution which causes tearing in thin foils, particularly in corners. Some desirable results without wrinkling or tearing have been obtained with matched metal dies, but due to failure rates for foil materials, matched metal die processes are limited to thicker workpiece materials for economical production levels. Lubricants may be applied to enhance forming and reduce tearing of thin foil workpieces, but introduce contaminants and necessitate a post-application cleaning step, increasing production costs. However, wrinkling remains a problem even where lubricants are used.

Thermoforming of superplastic metal materials is a low-pressure, high-temperature process. However, foil materials are limited to conventional thermoplastic metal materials, such as certain alloys of magnesium, zinc and aluminum capable of elongation of approximately 500 percent or more. While lower forming pressures are enjoyed, in addition to limited material choices, higher temperatures and related die warping and energy costs, as well as increased cycle times due to heating, are additional significant drawbacks of thermoforming.

Hydroforming, by contrast, is a high pressure, standard or ambient room temperature process. However, practical considerations make difficult the hydroforming of parts having a surface area greater than about 18 inches by 18 inches. Moreover, higher failure rates, i.e. incidence of tearing and wrinkling, occur in hydroforming thin foil materials, even where the foil is sandwiched between cull plates. Cull plates are thicker pieces of steel formed along with the foil workpiece to protect it. However, the use of cull plates increases cycle time and forming pressures. As well, since the cull plates are formed along with the thin foil, they are not reusable and exact a cost penalty in production. Rubber pad forming has similar drawbacks to hydroforming, such as the need for cull plates, and higher failure rates.

Finally, because moderate to high forming pressures and clamping forces are required to form foil materials, some of these above-mentioned forming operations use elastomeric or resilient surfaces in compression with the foil workpiece. Hereafter, elastomeric or resilient surfaces will be referred to as resilient surfaces. Wherever clamping forces and forming pressures bring a foil workpiece and resilient surfaces together, air is expelled from between the two, much like during compression of a suction cup. Because thin foils are compliant, air cannot easily re-enter the tight space between the foil and the resilient surface. After the forming operation is complete, the foil is left firmly adhered to the resilient surface. The foil is often damaged during the process of its removal, and may require manual removal. This occurs whether large surface areas or annular or peripheral areas of the foil materials are compressed against the resilient surface.

Conventional forming operations such as hydroforming and rubber pad forming overcome these further difficulties by sandwiching the thin foil between cull plates which can withstand the peel-back force typically encountered with rubber diaphragms and pads. However, these activities increase cycle time and production costs.

Another problem with forming thin foil sheet materials is that the pressure used to press the foil into the die cavity or forming cavity forces the foil against the forming cavity wall to an extent that the frictional forces prevent substantial lateral or sliding movement of the foil along the surface of the die cavity. Wherever the foil is forced against a stationary surface, it is essentially immobilized. It would be advantageous, however, for the foil to be able to slip or move along the forming cavity, especially in order to move the foil into deep or complex areas of the forming cavity.

There are several methods of lowering the coefficient of friction which enables the thin foil to slip along the bottom of the forming cavity. Conventional means include the use of lubricants, rubber sheets, and highly polished tool surfaces. Each of these methods has drawbacks. Formed parts need to be cleaned after forming if lubricants are used. Rubber sheets need to be set in place and removed before and after each use in order to have reasonably short cycle times. Highly polished surfaces add an additional cost to the tool manufacturing process. Even with existing methods of facilitating slip of the foil workpiece across the forming cavity surface, there are limits to the amount of slip of the foil. Limited slip reduces forming depth, forming rates, and the variety of foils which may be successfully formed.

Accordingly, improvements in forming thin foil sheet materials are needed to lower manufacturing costs and to enable the production of more complex shapes in forming products using thin foil materials.

DISCLOSURE OF INVENTION

There has now been developed a method for pneumatic forming of thin foil workpieces which enables an increased amount of slip of the foil workpiece. Air or other gases under pressure is supplied to the area between the foil and the forming cavity to act as an air bearing to enable the workpiece to be moved along the surface of the forming cavity during the forming of the foil workpiece. The thin layer of air enables the foil workpiece to be moved and stretched into deeper and more complex forming cavities without tearing or wrinkling and enables higher forming rates without exceeding material strain rate limitations.

According to this invention, there is provided a method for pneumatic forming of foil workpieces including the steps of positioning a foil workpiece between a first and a second forming element, where the second forming element has at least one forming cavity, moving the first and second forming elements into clamping relationship with the foil workpiece, increasing pneumatic pressure between the foil workpiece and the first forming element to form the foil workpiece into the forming cavity, supplying a gas between the foil and the second forming element sufficient to enable the foil workpiece to move along the surface of the second forming element during the forming of the foil workpiece into the forming cavity, and removing the foil workpiece in a formed condition from between the first and second forming elements. The gas can be supplied by a plurality of ports in the second forming element. The method of the invention is capable of fast cycle times and produces minimal waste because thin foil workpieces formed by this method have a reduced incidence of tearing and wrinkling of foil material.

In a specific embodiment of the invention, the second forming element has a central portion which is initially contacted by the foil workpiece upon the increase in pneumatic pressure between the first forming element and the foil workpiece, and the second forming element has at least one distal portion which is not initially contacted by the foil workpiece, and the gas supplying step comprises supplying a gas at an intermediate region between the central portion and the distal portion to facilitate movement of the foil workpiece from the central portion toward the distal portion. If the second forming element is the shape of a rectangle or other polygon, then the distal portion can be a corner.

In another embodiment of the invention, the second forming element has generally vertical walls and a generally horizontal main surface, which includes the central portion, with the walls and main surface defining corners. The gas supplying step can comprise supplying a gas through ports positioned on the generally horizontal main surface. Vents can be positioned in the corners to facilitate movement of the foil workpiece from the central portion into the corners.

In yet another embodiment of the invention, the second forming element has a central portion which is initially contacted by the foil workpiece upon the increase in pneumatic pressure between the first forming element and the foil workpiece, and has at least one concave portion which is not initially contacted by the foil workpiece, and the gas supplying step comprises supplying a gas at an intermediate region between the central portion and the concave portion to facilitate movement of the foil workpiece from the central portion into the concave portion.

In a specific embodiment of the invention, the second forming element has a generally flat central portion which is initially contacted by the foil workpiece upon the increase in pneumatic pressure between the first forming element and the foil workpiece, and has at least one distal portion which is a curved portion and which is not initially contacted by the foil workpiece, and the gas supplying step comprises supplying a gas at an intermediate region between the central portion and the curved portion to facilitate movement of the foil workpiece from the central portion toward the curved portion.

BEST MODE FOR CARRYING OUT THE INVENTION

Figure 1:
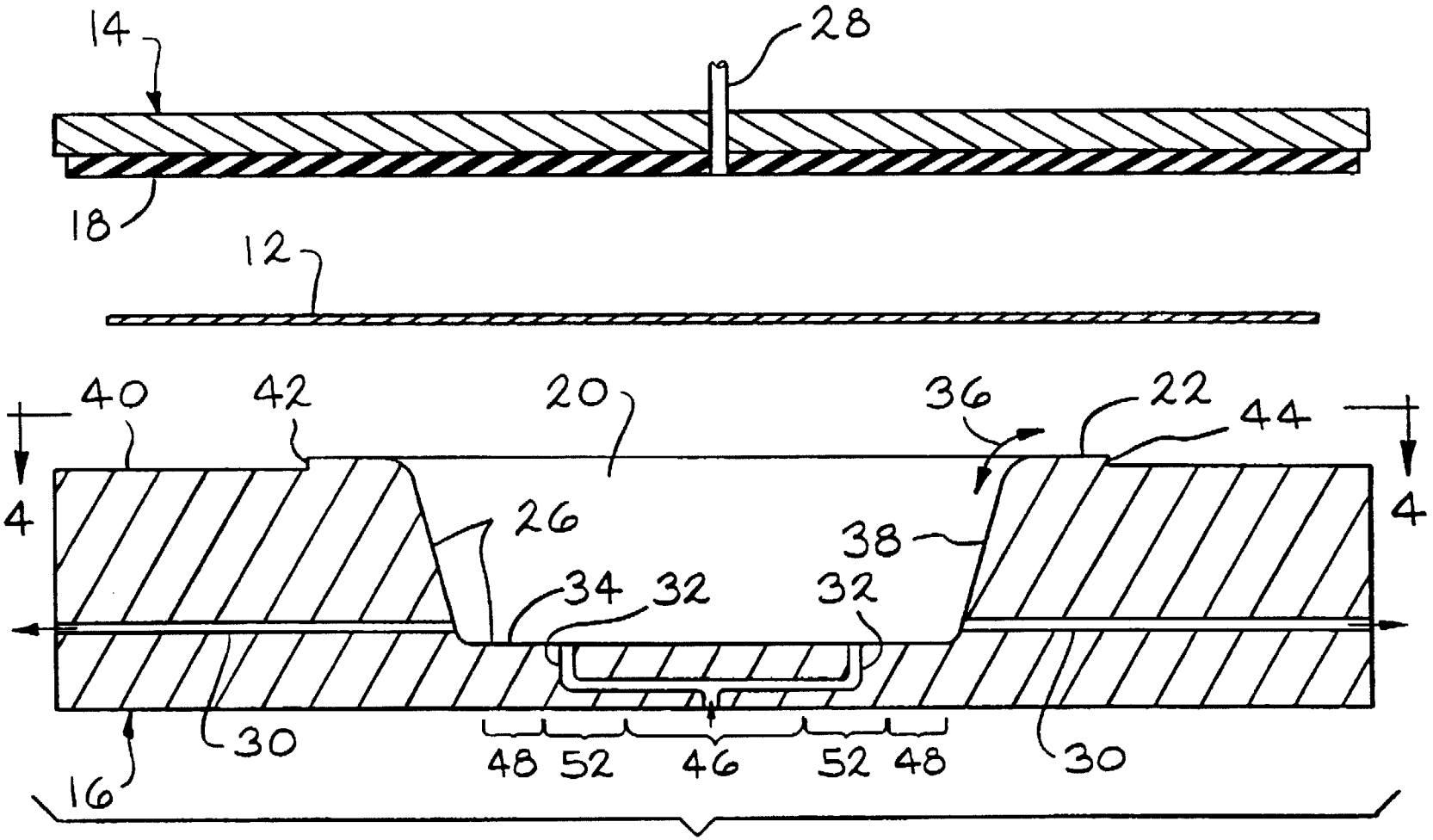
FIG. 1 is a schematic cross-sectional view in elevation of apparatus for forming foil workpieces according to the present invention.

The apparatus shown in the drawings can be used for performing the method of the present invention, which includes the use of pneumatic pressure and reduced, controlled net clamping pressure for reliable high speed forming of thin foil workpieces without lubricants or cull plates, producing formed thin foil parts with reduced incidence of tearing and wrinkling. The method and apparatus for forming thin foil workpieces is generally described in three commonly assigned, copending patent applications, which are hereby incorporated by reference. They are U.S. patent application Ser. No. 08/238,991, filed Jun. 14, 1994, (Hall et al.) and entitled METHOD AND APPARATUS FOR PNEUMATIC FORMING OF THIN FOIL MATERIALS; U.S. patent application Ser. No. 08/238,992, filed May 6, 1994 (Hall), and entitled METHOD AND APPARATUS FOR SHOCK RELEASE OF THIN FOIL MATERIALS; and U.S. patent application Ser. No. 08/239,158, filed Jun. 14, 1994 (Hall et al.) and entitled APPARATUS AND METHOD FOR RETENTION OF THIN FOILS DURING FORMING.

Referring to FIG. 1, the method for pneumatic forming of thin foil workpieces begins by positioning a foil workpiece 12 between a first forming element 14 and a second forming element 16. The first forming element has a resilient surface 18 to assist in clamping the foil during the forming process. The second forming element 16 has at least one forming cavity 20, preferably bounded by a second clamping surface 22. During the forming process, the first and second forming elements are moved into a clamping relationship with the foil workpiece, as further shown in FIG. 2. The resilient surface of the first forming element contacts the top of the foil workpiece while the clamping surface 22 of the second forming element contacts the bottom of the foil workpiece.

Figure 2:
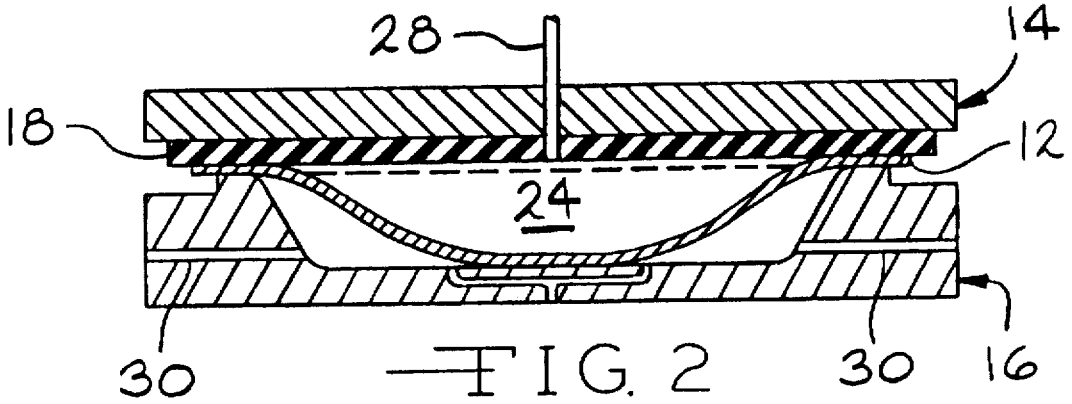
FIG. 2 is a schematic cross-sectional view in elevation of the apparatus of FIG. 1, with the workpiece at the beginning of the forming process.
Figure 3:
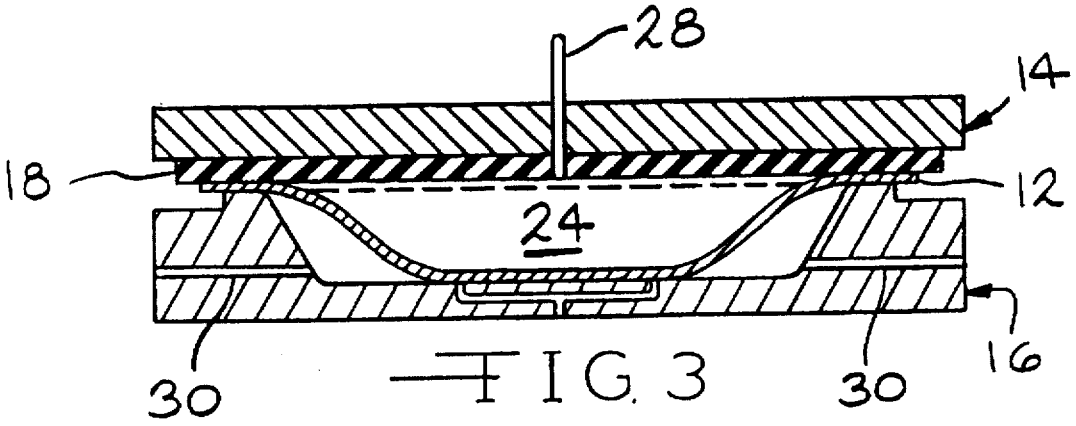
FIG. 3 is a schematic cross-sectional view in elevation of the apparatus of FIG. 1, with the workpiece nearing completion of the forming process.

Referring to FIG. 2, it can be seen that downward compression of the first forming element produces a seal around the volume 24 existing between the foil workpiece and the first forming element. The foil workpiece is then substantially formed into the forming cavity 20 by supplying pneumatic pressure to the volume 24. However, in accordance with the present invention, development of full clamping force is not a prerequisite to application of pneumatic pressure for forming. Once clamping force is initially applied to the forming elements 14, 16 to hold the foil workpiece in place, pneumatic pressure is supplied to the sealed volume 24 to expand and shape the workpiece against the surfaces 26 of the forming cavity. The pneumatic pressure can be supplied by any means, such as by supplying air or other gases under pressure through air supply tube 28 which extends through the first forming element. Forming is accomplished in accordance with the present invention by generally contemporaneously increasing both the clamping pressure holding the foil workpiece and the pneumatic pressure forming the workpiece.

The result of the two opposing forces (clamping force and pneumatic force) establishes a net clamping force and net clamping pressure upon the foil. Control over net clamping pressure is obtained by slightly lagging the pneumatic pressurization rate of the volume 24 behind the clamping rate characteristic of the press or other conventional device, not shown, which applies the clamping force. Conventional devices are, for example, hydraulic or mechanical presses, preferably having hydraulic tonnage control. Every such press or device requires a finite time to develop full clamping force, and the rate of development of clamping force is referred to as the clamping rate. Variation in the pneumatic pressurization rate and clamping rate permit one to control the net clamping force on the foil workpiece at the clamping surface 22. This controls the ability of the foil workpiece material to slip at the clamping surface during forming. It is imperative that at the beginning of and during a forming cycle, a minimum net clamping force is maintained by the resilient surface 18 on the clamping surface which is high enough to seal the pneumatic pressure into the volume 24.

As a result of pressurization of the volume 24 for forming during development of the clamping pressure, net clamping pressure is reduced during forming, and limited slip or movement of the foil material into or toward the forming cavity 20 during forming is controllable. Control over the net clamping pressure prevents using either too little clamping force, which would cause excess workpiece movement and wrinkling, or excessive clamping force which would inhibit forming for a particular material and application. Control over the net clamping pressure is exerted by varying either the increase in clamping pressure or the increase in pneumatic pressure, or both, as they are being performed contemporaneously.

If the foil workpiece is perforated for any reason, the perforations must be located in regions of the workpiece which are not subjected to the highest tensile stresses during the forming cycle to avoid propagating tears in the foil material. That is, typically perforations should be in the central flat areas of the workpiece. Gas must be prevented from escaping these perforations during forming by means of tapes or other sealing means (not shown) which will maintain pneumatic pressure in the volume 24 needed for forming.

As the foil workpiece is being formed into the forming cavity by the expansion of volume 24, it may be desirable to vent air from the area beneath the foil workpiece. The second forming element 16 is provided with at least one vent, such as corner vents 30, to enable air to escape. The vents can be positioned anywhere within the forming cavity, but are preferably positioned in the region which is the last to be covered by the foil workpiece during the forming process.

Near the completion of the forming step, the net clamping pressure is preferably established at a generally minimal pressure, while the pneumatic pressure is at a generally maximum pressure to complete forming. Further deforming of final portions of the foil workpiece may thus proceed, which is advantageous for material slip desired during final forming of corner portions of a workpiece.

Finally, at the end of the step of forming, if the pneumatic pressure of forming is further increased, net clamping force can become so low that the gas begins to leak across the clamping surface 22. After the forming process is completed, the foil workpiece, in a formed condition, is removed from between the first and second forming elements.

Control over the rate and amount of movement of thin foil material into or towards the forming cavity 20 allows more complete forming of shapes, assures forming of tighter radii in curves and corners, and allows for formation of deeper shapes. This slip or movement, however, is inhibited by frictional contact between the foil workpiece and the surfaces 26 of the forming cavity as the foil material approaches its desired shape. The problem of frictional contact inhibiting the slip or movement of the foil workpiece along the surface of the cavity is particularly troublesome near the completion of the forming process. The friction can be reduced by using highly polished surfaces.

A particularly effective method of reducing friction and enabling the forming of the foil around complex shapes, and shapes or curves having small radii, is to provide a source of air or other fluid, preferably a gas, to the bottom of the forming cavity. The apparatus for supplying the air acts as an air bearing.

The air bearing can be any device for supplying a gas between the foil workpiece and the second forming element. As shown, the air bearing can be a plurality of conduits, such as bottom gas ports 32 connected to a supply, not shown, of pressurized air. The gas ports are preferably provided along the horizontal main surface 34 of the forming cavity 20 to enhance formation of the foil workpiece into the corners, and to enable formation of tighter radii and deeper shapes than otherwise possible without the air bearing.

As the air bearing function is particularly beneficial during final forming, the introduction of gas via the gas ports may be delayed until the step of forming nears completion. That is, just prior to reaching maximum forming pressure, the gas supply to the volume 24 is diverted to the gas ports. Equal pressure above and below the foil enables it to "float" or be separated from the cavity surface, thereby reducing the frictional force that tends to impede further movement along the cavity bottom and into the corners and edges of the forming cavity.

Although the gas supply is not shown, and may be variously configured, it is understood that to quickly charge the volume 24 to levels of 600 psi, for example, the supply pressure must be higher than this value. Otherwise, long cycle times result.

Once the foil workpiece is formed, there remains the problem of its removal from the first and second forming elements and, in particular, from the resilient surface 18. The preferred method is a rapid release method, which rapidly changes the pressure in the forming cavity to jar or break loose the foil from the first and second forming elements. The clamping force and pneumatic force are relieved simultaneously across the clamping surface 22 for rapid pressure reduction, and pneumatic force is also relieved through the air supply tube 28.

It is to be understood from the above description that as pneumatic pressure increases in the volume 24 during forming, so must the clamping force. The key to short forming cycle times is to incur neither excessively low nor excessively high clamping pressures. Excessively high clamping pressures can result in no foil movement, which restricts forming depth, limits the types of metals which can be easily formed, affects the rate of forming, shortens the life of the elastomer seal, and greatly increases the probability of foil rupture for operations involving maximum forming depth. Proper control of clamp pressure during the pressurization cycle typically allows a permissible foil movement of approximately 0.05 cm (0.020 in) to 0.20 cm (0.080 in) while preventing the formation of wrinkles. This range will vary depending on the particular application.

In an example of a foil workpiece formed according to the method of the invention, pans were formed of 201 and 304 stainless steel foil material less than 0.0254 cm (0.010 in) thick, and in a preferred range of 0.0051 cm (0.002 in) to 0.0127 cm (0.005 in) in thickness. Stainless steel foil materials are preferably used for their low thermal conductivity and other significant properties for vacuum related applications, including corrosion resistance, strength, weldability, and tolerance to bake-out procedures during manufacturing. However, a wide range of materials is available.

Thin foil workpieces of 0.0076 cm (0.003 in) thickness have been repeatedly formed in accordance with the present invention. An open tray or pan shape approximately 26.7 cm (10.5 in) square having flanges was formed between the first and second forming elements. The forming cavity 20 further included a transition surface 36 having a radius of 0.38 cm (0.15 in) between the clamping surface 22 and the forming cavity walls 38. The walls are positioned at approximately 10 degrees from vertical, widening toward the open end of the forming cavity for easier removal of the formed part after forming.

A minimum clamping pressure is on the order of 14 bar (200 pounds per square inch [psi]) in combination with a clamping surface 22 and land area 40 of 0.95 cm (0.375 in) wide. Referring to FIG. 1, the distance across the forming cavity 20 from step 42 to step 44 (left to right as seen by the reader) is 46 cm (18 in) by 46 cm (18 in). The area of the clamping surface 22 plus land area 40 is approximately 170 $cm^2$ (26.4 $in^2$). The initial pneumatic pressure is about 3.4 bar (50 psi), while the initial clamping pressure is about 14 bar (200 psi).

Figure 4:
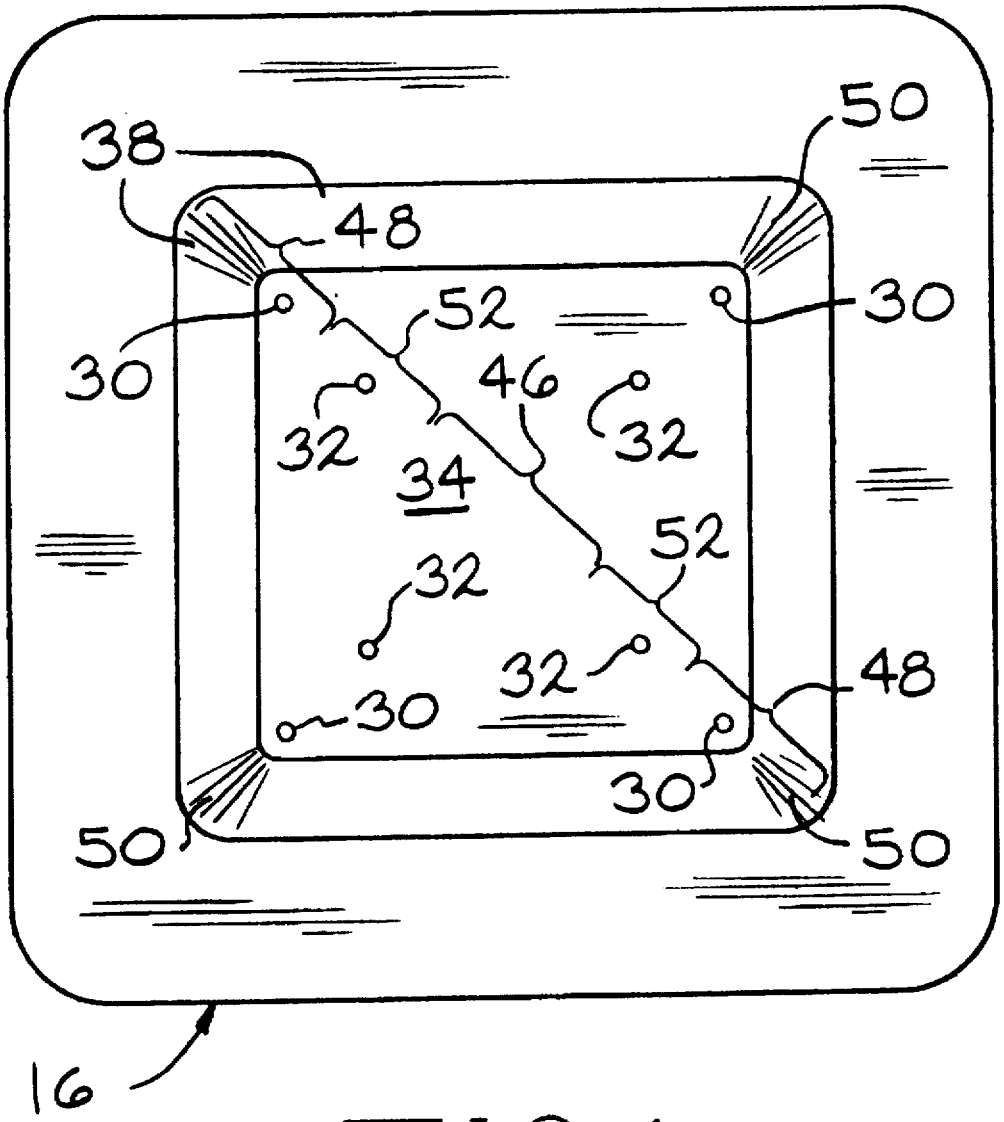
FIG. 4 is a schematic plan view of the apparatus of FIG. 1.

As shown in FIG. 4, the second forming element 16 can be in a rectangular shape, although other polygonal shapes and even non-polygonal shapes can be used. It can be seen that the second forming element has a center or central portion 46. Referring to FIG. 2, the central portion is the portion of the second forming element which is first contacted by the foil workpiece during forming. It can be seen that the final portion of the second forming element contacted by the foil workpiece is the distal portions 48, which are generally the farthest from the center of the second forming element. As shown in FIG. 4, the distal portions 48 are in the corners 50 of the rectangularly shaped forming cavity.

As the foil workpiece is formed, the foil needs to slide and stretch in order to reach and fill out all the cavities and distal portions of the second forming element. Sliding movement is referred to as drawing, which occurs when the material is moved from another area, such as from excess material in the vicinity of the clamping surface 22. Expansion or stretching is also occurring, and this refers to a thinning process. The movement or sliding of the foil across the surface of the second forming element is facilitated by introducing air from the air ports 32. As shown in FIGS. 1 and 4, the air ports are positioned in an intermediate region 52 between the central portion 46 and the distal portions 48. This insures that the foil workpiece can flow or slide toward the distal portions or corners.

Figure 5:
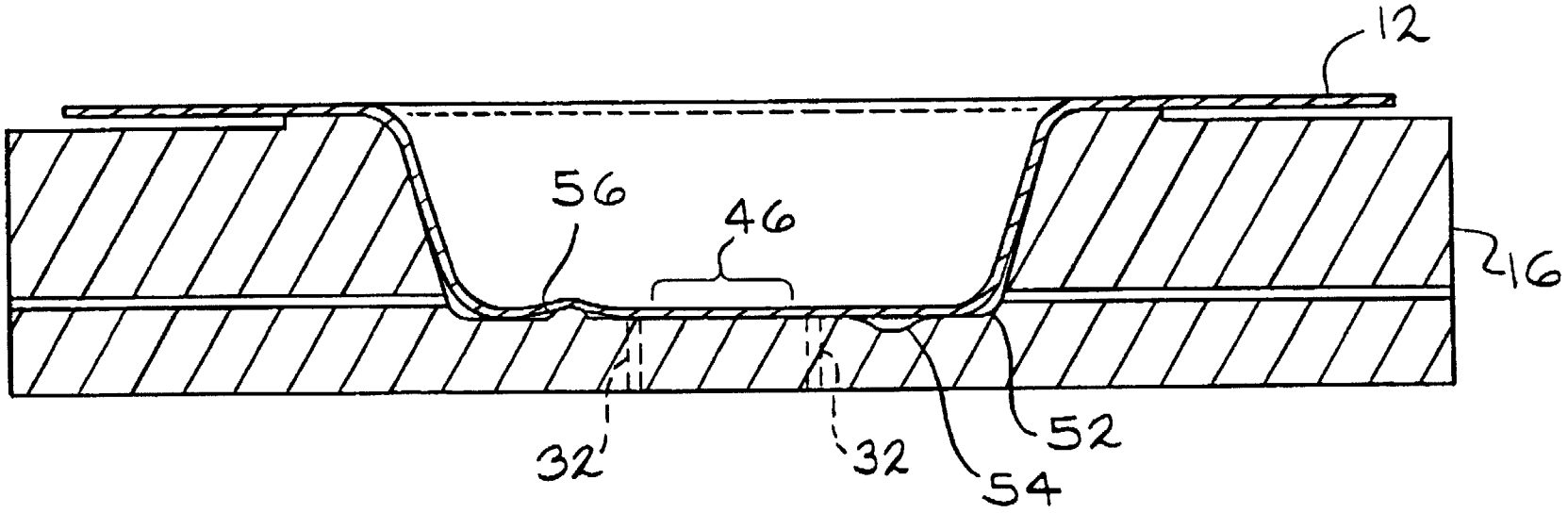
FIG. 5 is a schematic cross-sectional view in elevation of apparatus having convex and concave portions on the horizontal main surface.

As shown in FIG. 5, the contour of the second forming element 16 can include various surface irregularities such as curved portion 52, concave portion 54 and convex portion 56. These surface irregularities can all be considered to be variations of distal portions with respect to the central portion 46. In the case of each of these irregularities, the foil must be slid or moved in order the complete the forming process and ultimately provide a formed foil workpiece which is exactly the shape of the second forming element. In each instance, the gas ports 32 supply air or other gases to the forming cavity to act as an air bearing, thereby facilitating the movement of the foil workpiece into the distal portions of the second forming element.

During initial stages of forming in accordance with the present invention, relatively small pneumatic forming pressures on the foil workpiece can exert significant tensile hoop stress within the foil. If excessive movement of the foil material into or toward the interior of the forming cavity is permitted, the foil in the flange area of the workpiece will fail in compression by buckling and form wrinkles. The minimum clamping pressure is on the order of 14 bar (200 psi) for 0.076 cm (0.003 in) thick fully annealed 304 stainless steel foil.

In accordance with this example, pneumatic forming of the thin foil workpieces resulted in high quality pan shapes having wrinkle-free flanges. In addition to the advantages noted above, the pan shape formed in accordance with the present invention includes thinning of the material along the pan sides, and near corners. Presence of this thinner material in the pan sides further reduces conductive heat leak between warm and cold faces of the vacuum panel when applied to its intended use as thermal insulation. As may be appreciated, the present invention thus achieves rapid cycle times with reduced clamping pressures, greater control over forming process pressures and material slip, and high quality part production without waste.

Conventional cull plates which result in waste, lubricants which require additional cleaning steps, and conventional workpiece removal techniques which can result in damage to formed parts, are all avoided. Less stringent alignment and less costly forming element criteria may be enjoyed in accordance with the present invention, while higher quality, more reliable production of thin foil parts is achieved.

The method of the present invention is preferably performed with thin foil workpieces having a thickness less than approximately 0.025 centimeters (cm) (0.01 inches). Forming of such foil workpieces may be achieved in less than about six seconds in accordance with the present method. The method may be equally applied to the forming of foil workpieces into single or multiple forming cavities 20, and has the capability of being applied to form much larger workpiece surface areas than conventional methods when applied to foil workpieces, particularly the metal workpieces desired for many applications.

One proposed application for the present invention has been to form pan-shaped parts from thin foil materials for use in a vacuum insulation panel. Use of thin foil materials in such shapes present manufacturing problems with conventional methods and apparatuses which are overcome by the present invention. As a result, thin foil material thicknesses may be used cost-effectively to further reduce thermal conduction between cold and warm sides of the panel. In addition to reduced foil thickness, low thermal conductivity is enhanced by material selection.

It is to be understood that although pneumatic forming is highly preferred, other forming processes for forming foil workpieces can be used while still practicing the invention. For example, rubber pad forming or hydroforming could be used, while still using the air bearing advantages of the invention. In some cases, the second forming element, i.e., the element having the surface to which the foil workpiece is formed, is a convex element rather than a concave element. In each case, however, a gas is still supplied between the foil workpiece and the second forming element to enable the foil workpiece to move along the surface of the second forming element.

It will be evident from the foregoing that various modifications can be made to this invention. Such, however, are considered as being within the scope of the invention.

INDUSTRIAL APPLICABILITY

The invention can be useful in forming thin foil workpieces for use in high thermal resistance insulation panels for appliances.

I claim:

1. A method for pneumatic forming of foil workpieces comprising:

positioning a foil workpiece between a first and a second forming element, the second forming element having at least one forming cavity;

moving the first and second forming elements into a clamping relationship with the foil workpiece;

increasing pneumatic pressure between the first forming element and the foil workpiece to form the foil workpiece into the forming cavity;

supplying a gas between the foil and the second forming element sufficient to enable the foil workpiece to move along the surface of the second forming element during the forming of the foil workpiece into the forming cavity;

venting the gas from the area between the foil and the second forming element during forming to assist in moving the foil along the surface of the second forming element; and, removing the foil workpiece in a formed condition from between the first and second forming elements.

2. The method of claim 1 in which the second forming element has a central portion which is initially contacted by the foil workpiece upon the increase in pneumatic pressure between the first forming element and the foil workpiece, and the second forming element has at least one distal portion which is not initially contacted by the foil workpiece, and the gas supplying step comprises supplying a gas at a region between the central portion and the distal portion to facilitate movement of the foil workpiece from the central portion toward the distal portion.

3. The method of claim 2 in which the distal portion is a corner.

4. The method of claim 1 in which the second forming element has generally vertical walls and a generally horizontal main surface, which includes the central portion, with the walls and main surface defining corners.

5. The method of claim 4 in which the gas supplying step comprises supplying a gas through ports positioned on the generally horizontal main surface.

6. The method of claim 5 in which vents are positioned in the corners to facilitate movement of the foil workpiece from the central portion into the corners.

7. The method of claim 1 in which the second forming element has a central portion which is initially contacted by the foil workpiece upon the increase in pneumatic pressure between the first forming element and the foil workpiece, and at least one concave portion which is not initially contacted by the foil workpiece, and the gas supplying step comprises supplying a gas at a region between the central portion and the concave portion to facilitate movement of the foil workpiece from the central portion into the concave portion.

8. The method of claim 7 in which the second forming element has a generally horizontal main surface, and in which the gas supplying step comprises supplying a gas through ports positioned on the generally horizontal main surface.

9. The method of claim 1 in which the second forming element has a generally flat central portion which is initially contacted by the foil workpiece upon the increase in pneumatic pressure between the first forming element and the foil workpiece, and at least one distal portion which is a curved portion and which is not initially contacted by the foil workpiece, and the gas supplying step comprises supplying a gas at a region between the central portion and the curved portion to facilitate movement of the foil workpiece from the central portion toward the curved portion.

10. The method of claim 9 in which the second forming element has a generally horizontal main surface, and in which the gas supplying step comprises supplying a gas through ports positioned on the generally horizontal main surface.

11. A method for pneumatic forming of foil workpieces comprising:

positioning a foil workpiece between a first and a second forming element, the second forming element having at least one forming cavity, generally vertical walls and a generally horizontal main surface which includes a central portion which is initially contacted by the foil workpiece upon the increase in pneumatic pressure between the first forming element and the foil workpiece, and the second forming element having at least one distal portion which is a corner and which is not initially contacted by the foil workpiece;

moving the first and second forming elements into a clamping relationship with the foil workpiece;

increasing pneumatic pressure between the first forming element and the foil workpiece to form the foil workpiece into the forming cavity;

supplying a gas between the foil and the second forming element at a region between the central portion and the distal portion, through ports positioned on the generally horizontal main surface, in an amount sufficient to enable the foil workpiece to move along the surface of the second forming element during the forming of the foil workpiece into the forming cavity;

venting the gas from the area between the foil and the second forming element during forming to assist in moving the foil along the surface of the second forming element; and, removing the foil workpiece in a formed condition from between the first and second forming elements.

12. The method of claim 11 in which vents are positioned in the corners to facilitate movement of the foil workpiece from the central portion into the corners.

13. A method for pneumatic forming of foil workpieces comprising:

positioning a foil workpiece between a first and a second forming element, the second forming element having at least one forming cavity and a generally flat central portion which is initially contacted by the foil workpiece upon the increase in pneumatic pressure between the first forming element and the foil workpiece, and the second forming element having at least one distal portion which is a curved portion and which is not initially contacted by the foil workpiece;

moving the first and second forming elements into a clamping relationship with the foil workpiece;

increasing pneumatic pressure between the first forming element and the foil workpiece to form the foil workpiece into the forming cavity;

supplying a gas between the foil and the second forming element, at a region between the central portion and the curved portion, to facilitate movement of the foil workpiece along the surface of the second forming element from the central portion toward the curved portion during the forming of the foil workpiece into the forming cavity;

venting the gas from the area between the foil and the second forming element during forming to assist in moving the foil along the surface of the second forming element; and, removing the foil workpiece in a formed condition from between the first and second forming elements.

14. A method for forming foil workpieces comprising:

positioning a foil workpiece between a first and a second forming element;

moving the first and second forming elements into a clamping relationship with the foil workpiece;

applying pressure to the foil workpiece to force the foil workpiece toward the second forming element to form the foil workpiece into the shape of the second forming element;

supplying a gas between the foil and the second forming element sufficient to enable the foil workpiece to move along the surface of the second forming element during the forming of the foil workpiece;

venting the gas from the area between the foil and the second forming element during forming to assist in moving the foil along the surface of the second forming element; and, removing the foil workpiece in a formed condition from between the first and second forming elements.

15. The method of claim 14 in which the second forming element has a central portion which is initially contacted by the foil workpiece as the foil workpiece is forced toward the second forming element, and the second forming element has at least one distal portion which is not initially contacted by the foil workpiece, and the gas supplying step comprises supplying a gas at a region between the central portion and the distal portion to facilitate movement of the foil workpiece from the central portion toward the distal portion.

16. The method of claim 15 in which the distal portion is a corner.

17. The method of claim 14 in which the second forming element has generally vertical walls and a generally horizontal main surface, which includes the central portion, with the walls and main surface defining corners.

18. The method of claim 17 in which the gas supplying step comprises supplying a gas through ports positioned on the generally horizontal main surface.

19. The method of claim 18 in which vents are positioned in the corners to facilitate movement of the foil workpiece from the central portion into the corners.

20. The method of claim 14 in which the second forming element has a central portion which is initially contacted by the foil workpiece upon the increase in pneumatic pressure between the first forming element and the foil workpiece, and at least one concave portion which is not initially contacted by the foil workpiece, and the gas supplying step comprises supplying a gas at a region between the central portion and the concave portion to facilitate movement of the foil workpiece from the central portion into the concave portion.

* * * * *